US006466118B1

(12) United States Patent
Van Zeeland et al.

(10) Patent No.: US 6,466,118 B1
(45) Date of Patent: Oct. 15, 2002

(54) OVERLAY ELECTRICAL CONDUCTOR FOR A MAGNETICALLY COUPLED PUSHBUTTON SWITCH

(75) Inventors: Anthony J. Van Zeeland, Mesa, AZ (US); David VanZoest, Mesa, AZ (US)

(73) Assignee: Duraswitch Industries, Inc., Mesa, AZ (US)

( * ) Notice: Subject to any disclaimer, the term of this patent is extended or adjusted under 35 U.S.C. 154(b) by 0 days.

(21) Appl. No.: 10/124,253

(22) Filed: Apr. 17, 2002

(51) Int. Cl.[7] ..... H01H 9/00

(52) U.S. Cl. ..... 335/205; 335/206; 200/512; 200/519; 200/520; 200/521; 200/529; 200/530; 200/532; 200/534; 200/535

(58) Field of Search ..... 335/205–208; 200/512–521, 529–535, 553

(56) References Cited

U.S. PATENT DOCUMENTS 5,990,772 A * 11/1999 Van Zeeland ..... 200/521

* cited by examiner

*Primary Examiner*—Ramon M. Barrera
(74) *Attorney, Agent, or Firm*—Scott A. Hill

(57) ABSTRACT

A magnetically coupled pushbutton switch has a coupler magnet layer that normally holds an electrically conductive magnetic armature spaced from a substrate layer. An overlay having an overlay electrical conductor formed thereon covers the pushbutton switch. The overlay electrical conductor, which electrically contacts a crown on the armature, is part of a set of electrical conductors that is normally closed. When a user provided actuation force causes the armature to break away from the coupler magnet layer, the set of electrical conductors is opened.

14 Claims, 1 Drawing Sheet

OVERLAY ELECTRICAL CONDUCTOR FOR A MAGNETICALLY COUPLED PUSHBUTTON SWITCH

BACKGROUND OF THE INVENTION

Switches with magnetically coupled armatures provide a reliable and durable switching function. They combine the tactile feel of a bulky mechanical switch with the compactness of a conventional flexible membrane switch. The benefits of magnetically coupled pushbutton switches have been demonstrated in U.S. Pat. Nos. 5,523,730, 5,990,772 and 6,262,646, incorporated herein by reference. While switches with magnetically coupled armatures already have many applications, it is advantageous to expand the applications of such switches even further, and the present invention relates to an electrical conductor arrangement for use with a magnetically coupled pushbutton switch, the electrical conductor arrangement being particularly useful for medical equipment and other precision devices that require more from a switch than a casual user would demand. A frustration with pushbutton switches that most people have experienced with a calculator or phone is a condition called "tease." Tease is where a user presses on the pushbutton switch and believes a single actuation has occurred when, in fact, either no electrical connection was made or multiple connections where made.

Magnetically coupled pushbutton switches normally have a metal armature that is magnetically held by a coupler magnet layer in a rest position, spaced from switch contacts on a non-conductive substrate layer. A user-provided actuation force applied to a crown of the armature causes it to snap free of the coupler magnet layer and close the switch contacts by electrically connecting them. Release of the actuation force allows the coupler magnet layer to attract the armature back to the rest position to reopen the switch. A non-conductive spacer layer is fixed to the substrate layer, with a cavity in the spacer layer exposing the switch contacts. The coupler magnet layer overlies the spacer layer. The armature is magnetically coupled to the bottom of the coupler magnet layer so that the armature is housed within the cavity in the spacer layer. The armature crown protrudes through an aperture in the coupler magnet layer. Typically, a polyester membrane layer with suitable graphics overlies the coupler magnet layer to direct a user of the switch as to location and function of the switch.

SUMMARY OF THE INVENTION

A magnetically coupled pushbutton switch is characteristically designed to be a momentary switch that momentarily affects the logic of external electronics connected to the switch. Once an applied actuation force of a user is released from the pushbutton armature of the switch, the armature does not remain in the actuated position, but is returned to its rest position by the magnetic attraction of the coupler magnet layer. In being returned to its initial rest position, there is typically a return of the logic of the external electronics connected to the switch to their initial state. The electrical conductor arrangement of the present invention is capable of detecting, with great precision, the moment that the switch travels from an unactuated or partially actuated position to a fully actuated position. With the conductor arrangement of the present invention, the external electronics connected to the switch receive a signal indicating the switch is in an unactuated position or partially actuated position. In the prior art, the external electronics knew that the switch was in an unactuated position only because the armature was not connecting any electrical conductors of the switch. In both the switch of the present invention and any of the switches in the prior art, there is a set of electrical conductors on the substrate layer that is electrically connected when the switch is fully actuated.

For the switch of the present invention, there are additional electrical conductors that are normally closed in the unactuated position, but opened during the final travel of the armature into the actuated position. By this method of receiving a signal that positively confirms that the switch is in the "off" position until the switch is in the "on" position, there are two ways the external electronics know that the switch of the present invention was actuated, and how many times. After actuation, the external electronics receive two signals: first, that the switch is no longer in the rest position, and second that the switch is in the actuated position. This is accomplished by having additional electrical conductors on the coupler magnet layer and the membrane overlay. Electrical leads connect each circuit layer of the switch to electronics that are external to the switch. Electrical conductors on the circuit layers are arranged within the switch so that the pushbutton armature of the switch is movable into and out of shorting relationship with the electrical conductors to change the circuit logic for a circuit incorporating the switch. As used herein, the term "top" refers to that surface of any part in a cross sectional figure of the drawings that faces the top edge of the page, while "bottom" refers to that surface of any part in a cross sectional figure of the drawings that faces the bottom edge of the page.

DETAILED DESCRIPTION OF THE INVENTION

Figure 1:
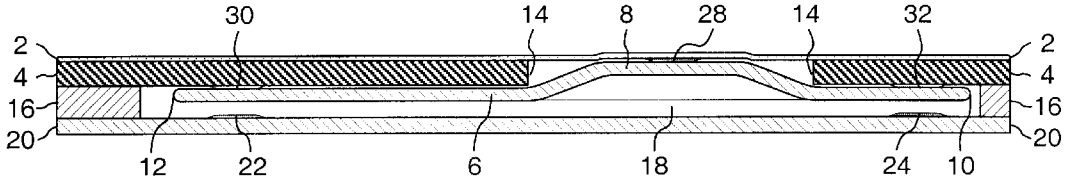
FIG. 1 is a cross-section of an overlay electrical conductor for a magnetically coupled pushbutton switch according to the present invention with the armature in the rest position.
Figure 2:
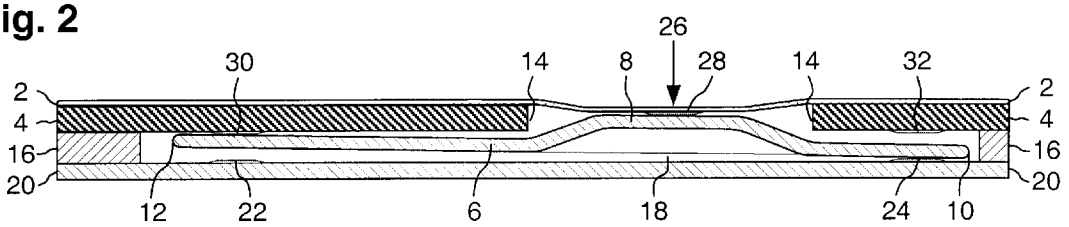
FIG. 2 is a cross-section similar to FIG. 1, but with the armature in the partially actuated position.
Figure 3:
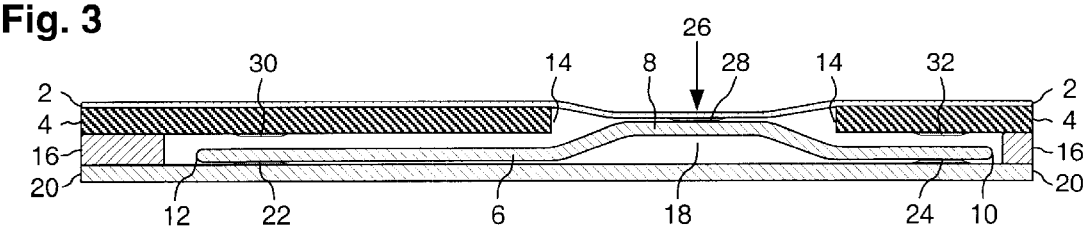
FIG. 3 is a cross-section similar to FIG. 1, but with the armature in the fully actuated position.

FIGS. 1 through 3 show a magnetically coupled pushbutton switch according to the present invention. Although the electrical conductor arrangement of the switch is of primary importance to the current invention, an understanding of how a magnetically coupled pushbutton switch operates is critical. The fundamental parts of a magnetically coupled pushbutton switch will be described from the top down, and then the improved method of detecting switch actuation will be described.

The top of the switch in FIGS. 1 through 3 has an overlay 2 that is a thin layer of flexible material that covers and seals the top of a magnetically coupled pushbutton switch. If desired, the overlay may be embossed and/or include actuator buttons. Suitable graphics may be printed on the top of the overlay 2 to indicate to a user the location and function of a particular switch. The overlay is preferably a polyester membrane that is adhesively fixed to the top of a coupler magnet layer 4. For the purposes of the present invention, the overlay and adhesive should be non-conductive.

The coupler magnet layer 4 is usually made from a flexible sheet magnet material, such bonded barium ferrite. For more robust switch applications, the coupler magnet layer 4 has a support material, such as polycarbonate, on the top surface of the sheet magnet material to make the coupler magnet layer less flexible. An armature 6 is magnetically coupled to the bottom of the coupler magnet layer 4. The armature 6 is a substantially flat piece of magnetic material that is electrically conductive. A sheet of soft steel coated with silver is a suitable armature material. The armature 6 includes a crown 8 that stands above the otherwise flat sheet of armature material. The crown 8 is located much closer to a heel end 10 of the armature 6. The end of the armature 6 opposite the heel end 10 is a toe end 12. When the armature 6 is magnetically coupled to the bottom of the coupler magnet layer 4, the crown 8 of the armature protrudes through an aperture 14 in the coupler magnet layer. Unlike the prior art, the crown 8 of the armature 6 must be electrically conductive and in electrical contact with the rest of the armature.

A spacer layer 16 attaches to the bottom of the coupler magnet layer 4. There is a cavity 18 in the spacer layer 16 that houses the armature 6. The spacer layer material is preferably high-density foam having a high-bond adhesive on the top and bottom surfaces, such as the foam sold by 3-M corporation under the trade name VHB. The bottom of the spacer layer 16 is adhesively fixed to a non-conductive substrate layer 20. There is at least one set of substrate electrical conductors 22 and 24 formed on the top surface of the substrate layer 20. Examples of substrate layer material include flex circuit and PCB board. All electrical conductors have electrical leads, not shown, that connect to external electronics.

There are three stable positions that the magnetically coupled pushbutton switch of the present invention may experience. FIG. 1 shows a first stable position, the rest position, where the armature 6 is magnetically coupled to the coupler magnet layer 4. In the absence of any external force, the armature 6 will position itself within the cavity 18 such that the crown 8 of the armature lies substantially within the aperture 14 in the coupler magnet layer 4 while the substantially flat part of the armature couples to the bottom surface of the coupler magnet layer. Preferably, the crown 8 of the armature 6 extends slightly above a plane defined by the top of the coupler magnet layer 4. The protruding part of the crown 8 causes the overlay 2 to bulge slightly, giving a user a better indication of the location of the switch. Because the overlay 2 receives an upward push from the crown 8 of the armature 6, the crown of the armature receives an equal but opposite downward force from the overlay. This condition, where the overlay 2 supplies a slight downward force on the crown 8 of the armature 6, is called preload.

FIG. 2 shows the second stable position, where the magnetically coupled pushbutton switch is in a partially actuated position. The partially actuated position is where the heel end 10 of the armature 6 has broken away from the coupler magnet layer 4 and traveled into contact with the substrate layer 20, but the toe end 12 of the armature has not significantly moved from its rest position. The armature 6 travels into the partially actuated position after a user provided actuation force 26 is applied to the top surface of the overlay 2, above the crown 8 of the armature. The crown 8 of the armature 6 remains in constant contact with the bottom of the overlay 2 so long as the actuation force 26 is being applied.

FIG. 3 shows the third stable position, where the magnetically coupled pushbutton switch is in the fully actuated position. The fully actuated position is where the heel end 10 and the toe end 12 of the armature 6 have successively broken away from the coupler magnet layer 4 and traveled to the substrate layer 20. The armature 6 will always travel to the partially actuated position before traveling to the fully actuated position. If a user applied actuation force 26 is applied slowly, a user will feel a tactile response through the overlay 2 indicating that the partially actuated position has been achieved. With continued application of the actuation force 26, the user will feel a tactile response indicating that the fully actuated position has been achieved. A rapidly applied actuation force 26 tends to blend the tactile feedbacks, indicating that the switch has achieved the second and third stable positions, into a single tactile feedback.

As in the prior art, the switch of the present invention has substrate electrical conductors 22 and 24 formed on the top surface of the substrate layer 20. The substrate electrical conductors 22 and 24 are electrically connected by the bottom surface of the armature 6 when the switch is in the third stable position. As seen in FIGS. 1 through 3, the switch of the present invention additionally has a unique overlay electrical conductor 28 on the bottom surface of the membrane overlay 2, the overlay electrical conductor being in electrical contact with the crown 8 of the armature 6 whenever there is a user provided actuation force 26. Any of the electrical conductors of the present invention may be formed directly on a surface, such as by printing or etching, or the electrical conductors may be formed on a thin sheet of non-conductive material that overlies a surface. For a switch designed with a membrane overlay 2 that provides preload, the overlay electrical conductor 28 will normally be in constant electrical contact with the crown 8 of the armature 6, even in the first stable position.

Preferably, the overlay electrical conductor 28 is part of a set of electrical conductors that is electrically connected by the top surface of the armature 6. In FIGS. 1 and 2, there is a toe electrical conductor 30 on the bottom surface of the coupler magnet layer 4 that is in electrical contact with the toe end 12 of the armature 6. The toe electrical conductor 30 and the overlay electrical conductor 28 are electrically connected by the armature 6 when the switch is in the first or second stable position, but the connection is broken when the toe end 12 of the armature breaks away from the coupler magnet layer 4 and travels to the third stable position.

The set of electrical conducts that may be connected by the top surface of the armature 6 may include a heel electrical conductor 32 on the bottom surface of the coupler magnet layer 4 for switches that are not designed with an overlay 2 that provides preload. The heel electrical conductor 32 and the overlay electrical conductor 28 are electrically connected, usually at some point that is external to the switch. Under exceptional conditions, such as a very low-pressure environment, an overlay 2 that normally provides preload may bulge away from the crown 8 of the armature 6 and break electrical contact with the overlay electrical conductor 28. If such a condition is anticipated, a heel electrical conductor 32 should be included to prevent the external electronics from receiving an indication that the circuit is inoperative. During a condition of bulge, the heel electrical conductor 32 will electrically contact the heel end of the armature when the switch is in the first position and mimic the contact normally made by the overlay electrical conductor.

If the overlay electrical conductor 28 is used as the common for the entire switch, there are numerous positions that may be independently observed. In the first stable position, the overlay electrical conductor 28 can only connect to the toe electrical conductor 30 and, if present, the heel electrical conductor 32. Between the first and second stable positions, called initial travel, the overlay electrical conductor 28 can only connect to the toe electrical conductor 30. In the second stable position, the overlay electrical conductor 28 can only connect to the toe electrical conductor 30 and substrate electrical conductor 24 that is below the heel end 10 of the armature 6. Between the second and third stable positions, called final travel, the overlay electrical conductor 28 can only connect to substrate electrical conductor 24. In the third stable position, the overlay electrical conductor 28 can only connect to the substrate electrical conductors 22 and 24. Particular switch applications will determine which electrical conductors should be utilized so that the external electronics receive appropriate electrical signals.

Full actuation of the switch occurs when a user provided breakaway force is sufficient to cause the toe end 12 of the armature 6 to travel from the toe electrical conductor 30 to the substrate electrical conductor 22. The final travel time is very rapid, typically less than twenty thousandths of a second. The external electronics will receive a signal indicating that the switch has left the second stable position and is in a state of final travel. Also, the external electronics receive a signal indicating that the switch has reached the third stable position. Tease that results in multiple actuations of the switch may be eliminated if the external electronics require that the switch return to the second stable position after every condition of full actuation. In this way, multiple switch actuations that would otherwise result can be avoided. Almost all accidentally multiple actuations of the switch occur because the armature 6 travels from the third stable position to a state of final travel, and then back to the third stable position. Requiring that the second stable position be, in effect, a reset position eliminates the multiple actuation scenario just described.

Another useful arrangement of the overlay electrical conductor 28 would be to eliminate the need for substrate electrical conductors 22 and 24. Because the coupler magnet layer 4 of a pushbutton switch is most strongly attracted to the armature 6 when the armature is closest to the coupler magnet, it is extremely difficult to encounter tease in the second stable position. If the external electronics recognize a normally closed switch as being unactuated, the final travel and third stable position may be used as the position of full actuation. In other words, when the overlay electrical conductor 28 breaks away from the toe electrical conductor 30, the external electronics recognize the condition of switch actuation. The main benefit of such an arrangement would be for situations where intentional switch actuation must be recognized by the external electronics, and a condition of tease that does not actually actuate the switch is not acceptable. An additional benefit of such a normally closed switch is that the switch provides an indication that a circuit incorporating the switch is operative.

While a preferred form of the invention has been shown and described, it will be realized that alterations and modifications may be made thereto without departing from the scope of the following claims. For example, where electrical conductors are normally formed directly on a surface, they could be formed on a thin sheet of polyester, or other nonconductive material, that overlies a surface. Also, it is assumed that all electrical conductors may be formed in duplicate and include electrical leads that are capable of being connected to electronics that are external to the switch.

What is claimed is:

1. An electrical conductor arrangement, for use with a magnetically coupled pushbutton switch having an overlay, a coupler magnet layer, an armature with a heel end and a toe end, and a substrate layer, the electrical conductor arrangement comprising:

a crown on the armature, the crown being a raised portion that is closest the heel end of the armature and farthest from the toe end of the armature, the armature and the crown being electrically conductive;

a first stable position of the switch, where the armature is magnetically coupled to the coupler magnet layer in a rest position;

a second stable position of the switch, where the armature is partially actuated such that the heel end of the armature has broken away from the coupler magnet layer and traveled to the substrate layer, but the toe end of the armature is in contact with the coupler magnet layer;

a third stable position of the switch, where the heel end of the armature and the toe end of the armature are in contact with the substrate layer, in a fully actuated position;

a state of initial travel of the switch, where the armature is in a position between the first stable position and the second stable position;

a state of final travel of the switch, where the armature is in a position between the second stable position and the third stable position;

an overlay electrical conductor that electrically contacts the crown at least when the armature is in the second or third stable position; and a first set of electrical conductors that may be electrically opened or closed by a user provided actuation force, the overlay electrical conductor being part of the first set of electrical conductors.

2. The electrical conductor arrangement of claim 1 wherein the overlay electrical conductor is normally in electrical contact with the crown when the armature is in the first stable position.

3. The electrical conductor arrangement of claim 1 further comprising a toe electrical conductor, the toe electrical conductor being on or adjacent the coupler magnet layer such that the toe end of the armature is not capable of electrically contacting the toe electrical conductor in the third stable position, the toe electrical conductor additionally being part of the first set of electrical conductors.

4. The electrical conductor arrangement of claim 3 further comprising a second set of electrical conductors, the second set of electrical conductors having a first substrate electrical conductor, the first substrate electrical conductor capable of electrically contacting the toe end of the armature when the switch is in the third stable position.

5. The electrical conductor arrangement of claim 4 wherein the overlay electrical conductor is part of the second set of electrical conductors.

6. The electrical conductor arrangement of claim 4 further comprising a second substrate electrical conductor, the second substrate electrical conductor being part of the second set of electrical conductors.

7. A method of making electrical contact in a magnetically coupled pushbutton switch having an overlay, a coupler magnet layer, an armature with a heel end and a toe end, and a substrate layer, comprising the steps of:

forming a crown on the armature that is electrically conductive, the crown being a raised portion that is closest to the heel end of the armature and farthest from the toe end of the armature;

creating a first stable position, where the armature is magnetically coupled to the coupler magnet layer in a rest position;

creating a second stable position, where the armature is partially actuated such that the heel end of the armature has broken away from the coupler magnet layer and contacted the substrate layer, but the toe end of the armature is in contact with the coupler magnet layer;

creating a third stable position, where the heel end of the armature and the toe end of the armature are in contact with the substrate layer, in a fully actuated position;

creating a state of initial travel, where the armature is in a position intermediate the first stable position and the second stable position;

creating a state of final travel, where the armature is in a position intermediate the second stable position and the third stable position;

forming an overlay electrical conductor that electrically contacts the crown at least when the armature is in the third stable position;

allowing a user provided actuation force to cause the armature to travel to any of the stable positions or through any of the states of travel;

forming a first set of electrical conductors that may be electrically opened or closed by the user provided actuation force, the overlay electrical conductor being part of the first set of electrical conductors.

8. The method of claim 7 wherein the overlay electrical conductor is normally in electrical contact with the crown when the armature is in the first stable position.

9. The method of claim 7 further comprising the step of forming a toe electrical conductor, the toe electrical conductor being on or adjacent the coupler magnet layer such that the toe end of the armature is not capable of electrically contacting the toe electrical conductor in the third stable position, the toe electrical conductor additionally being part of the first set of electrical conductors.

10. The method of claim 9 further comprising a the step of forming a second set of electrical conductors, the second set of electrical conductors having a first substrate electrical conductor, the first substrate electrical conductor being capable of electrically contacting the toe end of the armature when the switch is in the third stable position.

11. The method of claim 10 further comprising the step of making the overlay electrical conductor part of the second set of electrical conductors.

12. The method of claim 10 further comprising the step of forming a second substrate electrical conductor, the second substrate electrical conductor capable of electrically contacting the heel end of the armature, the second substrate electrical conductor additionally being part of the second set of electrical conductors.

13. A method of making a set of electrical conductors for a magnetically coupled pushbutton switch of the type having a coupler magnet layer that normally holds an electrically conductive magnetic armature spaced from a substrate layer, the method comprising the steps of:

defining a heel end of the armature that is opposite a toe end of the armature, the heel end of the armature always breaking away from the coupler magnet layer before the toe end of the armature when a user provided actuation force is applied to the pushbutton switch;

making a top face on the armature that is electrically conductive, the top face being that part of the armature that is normally held in coupled engagement with the coupler magnet layer; and forming a toe electrical conductor on or adjacent a bottom surface of the coupler magnet layer, the bottom surface of the coupler magnet layer being able to contact the top face of the armature, and the toe electrical conductor being able to contact the toe end of the armature.

14. The method of claim 13 further comprising the steps of:

fabricating an overlay having a top and bottom surface, the bottom surface of the overlay attaching to a top surface of the coupler magnet layer, the top surface of the coupler magnet being opposite the bottom surface of the coupler magnet;

making a crown on the top face of the armature that is closest to the heel end of the armature and farthest from the toe end of the armature;

making the crown so that it is electrically conductive; and forming an overlay electrical conductor on the bottom surface of the overlay, the overlay electrical conductor being capable of electrically contacting the crown.

* * * * *